United States Patent [19]

Stog

[11] 4,381,972

[45] May 3, 1983

[54] COKE-OVEN DOOR

[75] Inventor: Wilhelm Stog, Waltrop, Fed. Rep. of Germany

[73] Assignee: WSW-Planungs-GmbH, Waltrop, Fed. Rep. of Germany

[21] Appl. No.: 349,169

[22] Filed: Feb. 16, 1982

[30] Foreign Application Priority Data

Feb. 17, 1981 [DE] Fed. Rep. of Germany ..... 3105703
Feb. 17, 1981 [DE] Fed. Rep. of Germany ..... 3105726

[51] Int. Cl.[3] ..... C10B 25/06; C10B 29/04
[52] U.S. Cl. ..... 202/248; 202/268
[58] Field of Search ..... 202/248, 268, 270; 110/173 R; 49/483, 485

[56] References Cited

U.S. PATENT DOCUMENTS 2,993,845 7/1961 Coe ..... 202/248
4,086,145 4/1978 Muller ..... 202/248
4,217,177 8/1980 Gerding et al. ..... 202/248
4,263,101 4/1981 Thiersch et al. ..... 110/173 R

FOREIGN PATENT DOCUMENTS 28679 5/1981 European Pat. Off. ..... 202/248

*Primary Examiner*—Bradley Garris
*Attorney, Agent, or Firm*—Karl F. Ross

[57] ABSTRACT

A coke-oven door for a horizontal coking chamber has a metallic body with an inner surface covered by a thermally insulating layer and a metal plate mounted with the aid of vertically separated spacers on that inner surface. The plate consists essentially of a multiplicity of sections longitudinally adjoining or overlapping one another with limited mobility to facilitate relative thermal expansion. Each spacer comprises a first member secured to the door body and a second member coupled with an associated plate section, or with two such sections in their region of overlap, these members being interconnected with mutual play and/or with relative adjustability.

8 Claims, 5 Drawing Figures

COKE-OVEN DOOR

CROSS-REFERENCE TO RELATED APPLICATIONS

This application contains subject matter disclosed in two commonly owned applications in the names of Dieter Breidenbach et al, namely Ser. No. 303,609, filed Sept. 18, 1981 as a division of application Ser. No. 182,004 filed Aug. 27, 1980 and now abandoned, and application Ser. No. 332,317, filed Dec. 18, 1981 as a continuation-in-part of the former.

FIELD OF THE INVENTION

My present invention relates to a door for a coking chamber of a coke-oven battery, designed to fit between a pair of door jambs at the ends of two major parallel chamber walls.

BACKGROUND OF THE INVENTION

As disclosed in the above-identified commonly owned applications, such a coke-oven door advantageously comprises a metallic body or frame sealingly engaging the door jambs in its operating position, this frame carrying a heat-insulating layer over substantially its entire inner surface facing the coking chamber, and an upright heat-transmitting metal plate separated from the thermally insulated frame surface by a vertical gas channel, this plate being divided into a multiplicity of longitudinally adjoining and preferably overlapping sections. The channel is accessible from the interior of the associated coking chamber so that gases evolving from the coal charge may enter it and transmit part of their sensible heat through the metal plate to that charge which is therefore thermally cured not only through the heated longitudinal chamber walls, in accordance with conventional practice, but also at each end fitted with such a door. The plate sections are carried on the frame by support means in the form of spacers which are fixedly anchored to that frame at one end and are coupled at the other end with the plate sections in such a manner as to facilitate their relative thermal expansion. As particularly disclosed in application Ser. No. 332,317, such a coupling may be formed by a bolt projecting from the respective spacer through aligned openings in overlapping portions of two plate sections, one such opening being designed as a guide slot enabling relative longitudinal motion of these two sections. Aside from specially designed end brackets at the bottom and the top of the channel, the spacers may have the form of generally H-shaped stays also serving to hold the thermally insulating layer in position on the frame.

Even in the case of coking chambers with identical door openings it may be necessary to vary the separation of the metal plate from the door body from one instance to another. It may also be desirable, under some circumstances, to replace the sections of the heat-transmitting metal plate of an installed door by sections of different thickness.

OBJECT OF THE INVENTION

Thus, the object of may present invention is to provide improved means for supporting such a heat-transmitting plate on its door body in a conveniently adjustable manner.

SUMMARY OF THE INVENTION

In accordance with my present invention, the spacers supporting the heat-transmitting plate each have a first member fixedly secured to the frame or body of the door and a second member coupled with an associated plate section, or pair of overlapping sections, these members being interengageable in at least two different relative positions within a vertical plane perpendicular to the plate.

For this purpose, the two spacer members may have mutually overlapping perforated portions penetrated by one or more bolts linking them to each other; with suitable duplication of the perforations of at least one member, the bolt or bolts may be selectively inserted into them to establish one or another relative position. Alternatively, or in addition, the members of a spacer may be separated from each other with enough clearance to allow a shifting into different relative vertical positions, e.g. under thermal expansion; such a construction allows the second member of each spacer to be fixedly connected with a single associated plate section.

In order to hold adjoining plate sections centered on a vertical plane of symmetry in all their positions of adjustability relative to the frame, I may provide adjoining sections with guide means maintaining their alignment while enabling their relative displacement parallel to that plane.

BRIEF DESCRIPTION OF THE DRAWING

The above and other features of my invention will now be described in detail with reference to the accompanying drawing in which.

SPECIFIC DESCRIPTION

Figure 1:
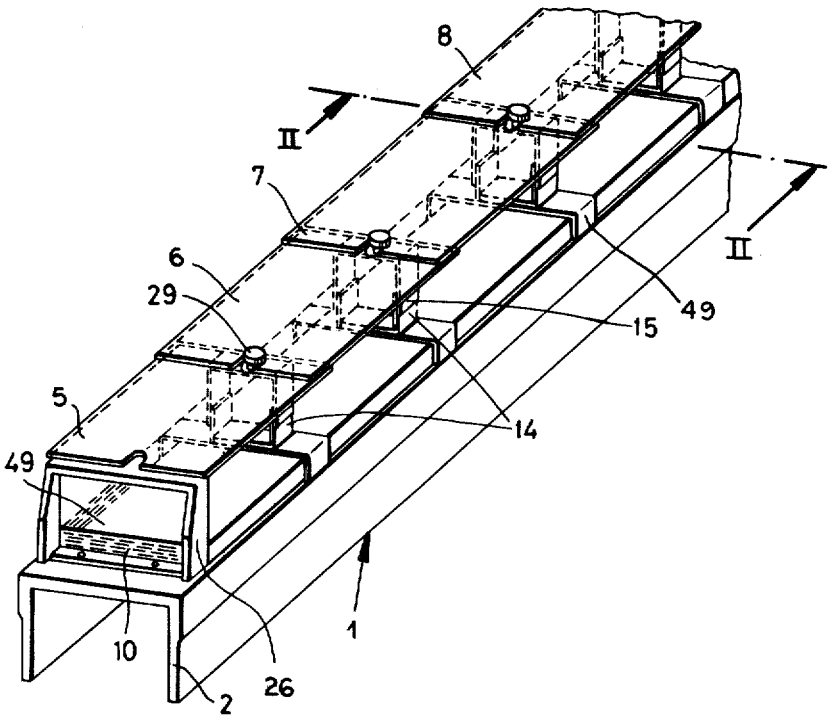
FIG. 1 is a partial perspective view of a coke-oven door embodying my invention.

In FIG. 1 I have shown part of a coke-oven door generally similar to one illustrated in the above-identified commonly owned application Ser. No. 332,317 whose disclosure is hereby incorporated by reference in my present application. The door comprises a metallic body or frame 2 of generally U-shaped profile with outwardly facing flanges which may be provided with nonillustrated lateral sealing strips designed to make contact with respective door jambs of a coking chamber. The inner surface of frame 2, i.e. the one confronting the coking chamber, carries a thermally insulating layer 10 such as a mat of refractory fibers extending over substantially its entire area; layer 10 is overlain by a relatively thin metallic shell 49 which may be divided into a multiplicity of sections substantially coextensive with sections 5, 6, 7, 8 . . . of a heat-conducting metal plate defining therewith a vertical gas channel. This metal plate is held separated from frame 2 by a multiplicity of spacers including a bracket-shaped bottom spacer 26, carrying the lowest plate section 5, and a nonillustrated top spacer of similar configuration which holds the uppermost plate section in position and may be provided with an opening for a leveling rod if the door is to be mounted on the pusher side of the coking chamber. The intermediate spacers each consist of a first member 14, bolted to frame 2 so as to serve also as a retainer for layer 10, and a second member 15 coupled by a bolt 29 with overlapping zones of two adjoining plate sections in a manner facilitating a relative vertical shifting due to thermal expansion. The two members 14, 15 of each of these spacers are adjustably interconnected as more fully described hereinafter with reference to FIGS. 2 and 3.

Each spacer member 14, 15 is generally U-shaped and is provided with respective perforations 88, 89 through which bolts 86 with nuts 87 are passed to hold these members in a selected relative position. Perforations 88 of member 14 are shown to be staggered in four horizontal rows while perforations 89 of member 15 are arrayed in two rows; according to the alignment chosen, these members may be shifted either horizontally or vertically from the relative position shown in FIG. 3. Member 14 is shown fastened to frame 2 by bolts 90 having nuts 91, these bolts traversing the layer 10 between sections of shell 49.

Figure 2:
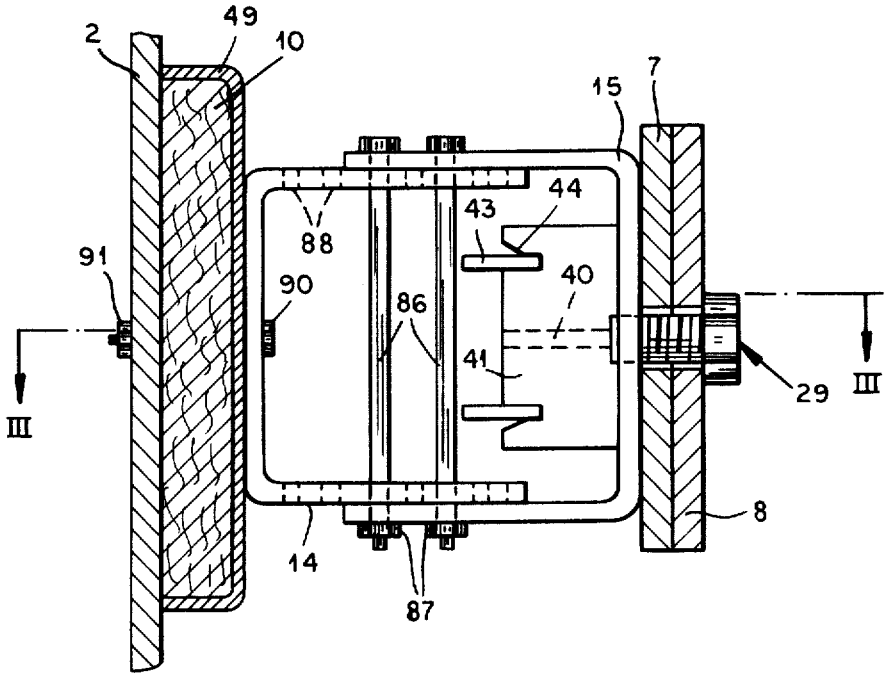
FIG. 2 is a fragmentary cross-sectional view of the door of FIG. 1, taken on a line II—II and drawn to a larger scale.
Figure 3:
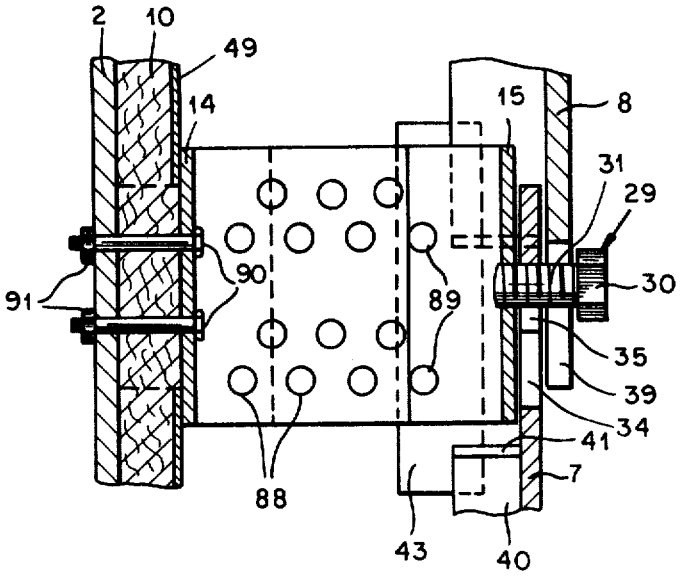
FIG. 3 is a fragmentary longitudinal sectional view taken on a line III—III of FIG. 2.
Figure 4:
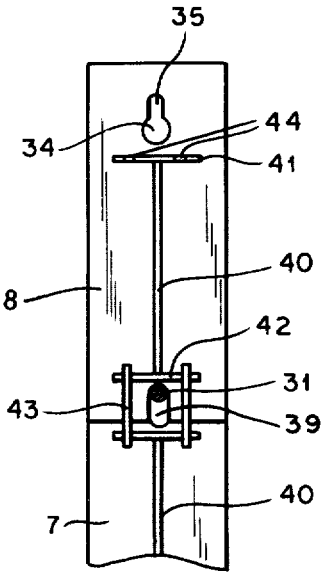
FIG. 4 is a partial face view of two overlapping plate sections seen in FIGS. 1-3.

The bolt 29 coupling the member 15 of FIGS. 2 and 3 with overlapping plate sections 7 and 8 has a head 30 and a shank 31 which, as indicated, may be threadedly fastened to member 15 in order to accommodate plate sections of different thicknesses; if thickness variations are not significant, the shank 31 may be fixedly soldered or welded to that spacer member. As best seen in FIG. 4, each plate section is provided near its upper end with a keyhole-shaped aperture 34, 35 while its lower end has an open slot 39. This slot and the narrower keyhole portion 35 accommodate only the shank 31 of bolt 29 while the wider keyhole portion 34 gives passage to head 30.

Thus, spacer member 15 may be assembled with associated plate sections 7 and 8 by passing its bolt head 30 through the wider keyhole portion 34 of the proximal section 7 and thereafter inserting the bolt shank 31 into the open-ended slot 39 of the more remote section 8. In the position illustrated in FIGS. 2 and 3, plate section 7 has descended from its insertion position so that shank 31 lies in the narrower upper keyhole portion 35.

FIGS. 2–4 also show the several plate sections provided, on their sides facing the frame 2, with I-shaped reinforcements each comprising a vertical rib 40 and a pair of horizontal ribs 41, 42. The latter ribs have incisions 44 accommodating respective metallic guide strips 43 which bridge adjoining plate sections and tend to hold them aligned with each other. Each guide strip may be slidable in the incisions 44 of both ribs 41, 42 of adjoining place sections, being thus held in place only by friction, but could also be fixedly secured to one of these ribs for positive retention thereon.

Figure 5:
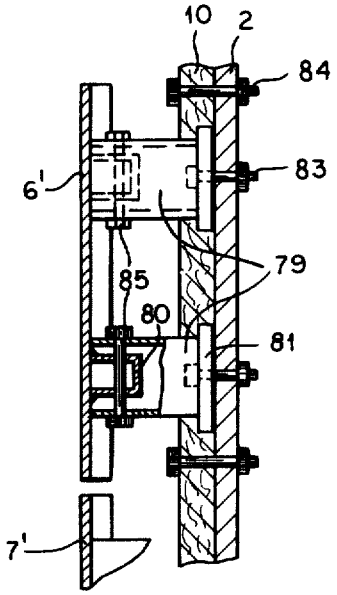
FIG. 5 is a fragmentary longitudinal sectional view of a modified coke-oven door embodying my invention.

In FIG. 5 I have shown sections 6', 7' of a modified heat-transmitting plate which do not overlap but are separated from one another by small gaps. These plate sections are secured to frame 2 by spacers each comprising a first member 79, bolted to the frame at 83 (possibly with interposition of a heat-transmitting disk not shown), and a second member 80 soldered or welded to an associated plate section. Members 79 and 80, which may be either cylindrical or prismatic, are both shown to be tubular although member 80 could also be solid. Member 80 of each spacer is received within the corresponding member 79 with enough vertical clearance to allow a shifting of the associated plate section, e.g. 6', relative to frame 2; these members are provided with aligned holes traversed by bolts 85. The surrounding members 79 are shown to have enlarged heads 81 partly overlain by the thermally insulating layer 10. Two vertically separated spacers are provided for each plate section in order to hold same in its proper upright position.

In this instance, too, the spacers 79, 80 may be made adjustable for the purpose of varying the width of the gas channel by providing either of these members with two or more pairs of holes into which the bolts 85 can be inserted; in that case the inner members 80 may have to be suitably lengthened. It should be noted, however, that the illustrated position provides greater stability for the plate sections 6', 7' since they are in direct contact with the larger spacer members 79. Shell 49 has been omitted in the embodiment of FIG. 5, with layer 10 directly secured to frame 2 by bolts 84.

I claim:

1. A door for a coking chamber of a coke-oven battery provided with a pair of doorjambs at the ends of two major parallel chamber walls, comprising:

a frame sealingly engaging said doorjambs;

an upright heat-transmitting metal plate disposed parallel to said frame and separated therefrom by a vertical channel, said plate being divided into a multiplicity of longitudinally adjoining sections;

supporting means mounting said plate on said frame while providing access to said channel from the interior of an associated coking chamber fitted with the door and permitting upward flow of gases entering said channel from said coking chamber, said support means including a multiplicity of spacers each having a first member fixedly secured to said frame and a second member coupled with at least one of said sections, said members being interengageable in at least two different relative positions within a vertical plane perpendicular to said plate; and a heat-insulating layer on said frame extending over substantially the full width and height of said frame within said channel.

2. A door as defined in claim 1 wherein said first and second members of each spacer overlap each other and are provided with respective perforations traversed by bolts linking said members to each other.

3. A door as defined in claim 2 wherein said first and second members of each spacer are vertically separated with enough clearance to enable a relative shifting along said bolts.

4. A door as defined in claim 2 wherein the perforations of at least one of said members are duplicated for alignment with perforations of the other of said members in different relative positions.

5. A door as defined in claim 4 wherein said relative positions are offset from one another in a direction perpendicular to said frame and said plate.

6. A door as defined in claim 1, 2, 4 or 5 wherein adjoining sections of said plate have overlapping zones engaged by a common spacer, said second member of the engaging spacer being provided with a headed fastener, the overlapping zone of a plate section proximal to the engaging spacer having a keyhole with a wider end clearing the fastener head and a narrower end accommodating only a shank portion of said fastener, the overlapping zone of a plate section more remote from the engaging spacer having an open-ended slot of substantially the same width as said narrower end traversed by said shank portion.

7. A door as defined in claim 6 wherein said shank portion is threadedly secured to said second member of the engaging spacer.

8. A door as defined in claim 1, 2, 3, 4 or 5 wherein adjoining sections of said plate are provided with guide means maintaining said sections aligned while enabling their relative displacement parallel to said plane.

* * * * *